US005278572A

United States Patent [19]

Harada et al.

[11] Patent Number: 5,278,572

[45] Date of Patent: Jan. 11, 1994

[54] ANTENNA COUPLING CIRCUIT USING CAPACITIVE COUPLING

[75] Inventors: Takuji Harada; Moriyoshi Kawasaki, both of Kanagawa, Japan

[73] Assignee: Harada Kogyo Kabushiki Kaisha, Tokyo, Japan

[21] Appl. No.: 734,612

[22] Filed: Jul. 23, 1991

[30] Foreign Application Priority Data

Nov. 1, 1990 [JP] Japan ..... 2-296653

[51] Int. Cl.[5] ..... H01Q 1/32

[52] U.S. Cl. ..... 343/715; 343/713

[58] Field of Search ..... 343/713, 715, 745, 860; 333/204, 246; H01Q 1/10, 1/32

[56] References Cited

U.S. PATENT DOCUMENTS

| | | | |
|---|---|---|---|
| 4,764,773 | 8/1988 | Larsen et al. | 343/715 |
| 4,772,862 | 9/1988 | Kubo et al. | 333/204 |
| 4,785,305 | 11/1988 | Shyu | 343/715 |
| 4,857,939 | 8/1989 | Shimazaki | 343/713 |
| 4,931,806 | 6/1990 | Wunderlich | 343/713 |
| 4,992,800 | 2/1991 | Parfitt | 343/713 |
| 4,999,642 | 3/1991 | Wells | 343/715 |
| 5,105,201 | 4/1992 | Nakase et al. | 343/715 |

*Primary Examiner*—Rolf Hille
*Assistant Examiner*—Peter Toby Brown
*Attorney, Agent, or Firm*—Koda and Androlia

[57] ABSTRACT

A capacitive antenna coupling circuit including a counter electrode which is connected to one end of at least one meandering conductor and a peripheral conductor connected to the other end of the meandering conductor which forms a capacitor between itself and the counter electrode.

6 Claims, 2 Drawing Sheets

ANTENNA COUPLING CIRCUIT USING CAPACITIVE COUPLING

BACKGROUND OF THE INVENTION

1. Field of the Invention

The present invention concerns an antenna coupling circuit using capacitive coupling.

2. Prior Art

Various means are known for transmitting high-frequency signals through the window glasses of automobiles without holes in said window glasses.

For example, methods in which inductive coupling is accomplished by installing coils facing each other on both sides of an insulator (glass, etc.), and capacitive coupling methods in which capacitive coupling is accomplished by installing electrode conductors facing each other on both sides of such an insulator so that a capacitance is formed, are known. Furthermore, in these methods, tuning to desired frequencies is performed so that transmission can be effectively accomplished.

Examples of the above include U.S. Pat. Nos. 4,089,817; 4,238,799; 4,658,259; 4,785,305; and 4,794,394.

In cases where inductive coupling is accomplished by means of coils in the conventional methods, the coils are ordinarily used with a degree of couplinq K in the vicinity of 1 (the degree of coupling K is the product of the coupling coefficient K and the tuning coefficient Q). In the 900 MHz frequency band used in automobile telephones, the coil diameter required in order to obtain a degree of coupling K of 1 is at least approximately 30 mm due to the thickness of the glass. In this case, furthermore, the coil length must also be approximately 30 mm. Moreover, the dimensions of the case, a metal case in some instances, which accommodates each coil are approximately twice the dimensions mentioned above. Accordingly, in cases where an antenna coupling circuit which uses inductive coupling by means of coils is attached to the window glass of an automobile, the coil parts are large and create an eyesore. These parts are undesirable from an esthetic standpoint, and are also an impediment to proper washing of the vehicle.

Meanwhile, in conventional methods in which signals are transmitted via a capacitance (as described above), an inductance element and a tuning cavity must be combined with the coupling capacitance for tuning purposes. Accordingly, the same problems generated in the case of antenna coupling circuits using inductive coupling by means of coils as described above are also generated here.

Furthermore, methods which transmit signals via capacitance include methods in which two pairs of electrodes are caused to face each other via a glass. In such methods, the certain problems arises in cases where unbalanced lines such as coaxial lines are used as signal lines. In particular, since a polarity exists in the two pairs of electrodes, the direction of attachment of the electrodes that are to form pairs must be the same between the units inside and outside the passenger compartment. In other words, if the direction of attachment of the electrodes that are to form pairs is reversed (i.e., if the electrodes are attached in reverse in structural terms), the prescribed performance cannot be achieved.

In addition to the methods described above, a method is known in which resonance circuits based on distributed constant plane circuits are caused to face each other on both sides of a window glass. However, even in cases where this method is used, the distributed constant circuits must have a large area in order to obtain the desired degree of coupling. As a result, the field of vision through the window glass is obstructed.

SUMMARY OF THE INVENTION

The object of the present invention is to provide an antenna coupling circuit using capacitive coupling which does not project any great distance from the surface of the window glass, and which causes little obstruction of the field of vision.

In keeping with the principles of the present invention the objects or accomplished by a capacitive antenna coupling circuit including a counter electrode which is connected to one end of at least one meandering conductor, and which has an area larger than the area of said meandering conductor, and a peripheral conductor which is connected to the other end of the above-described meandering conductor, and which forms a capacitance between itself and the counter electrode.

Since the present invention has a counter electrode which is connected to one end of a meandering conductor, and which has an area larger than the area of said meandering conductor, and a peripheral conductor which is connected to the other end of the meandering conductor, which forms an inductance between itself and the meandering conductor, and which forms a capacitance between itself and the counter electrode, the circuit of the present invention does not project any great distance from the surface of the window glass and thus causes little obstruction of the field of vision.

BRIEF DESCRIPTION OF THE DRAWINGS

FIG. 6 shows a modification of the embodiment illustrated in FIG. 6 (1);

DETAILED DESCRIPTION OF THE INVENTION

Figure 1:
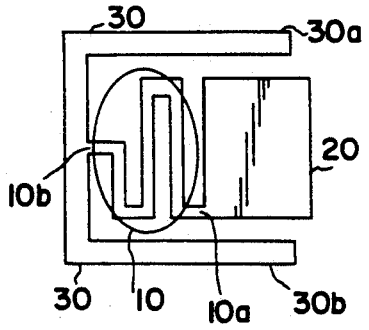
FIG. 1 is a plan view which illustrates one embodiment of the present invention.

The antenna coupling circuit C1 shown in FIG. 1 has a meandering conductor 10, a counter electrode 20 and a peripheral conductor 30. These parts are formed on a printed circuit board. Furthermore, the meandering conductor 10 is shown enclosed by an oval.

The counter electrode 20 is connected to one end 10*a* of the meandering conductor 10, and has an area which is larger than the area of said meandering conductor 10.

The peripheral conductor 30 is connected to the other end 10*b* of the meandering conductor 10; this conductor 30 forms an inductance L between itself and the meandering conductor 10, and forms a capacitance C between itself and the counter electrode 20.

Furthermore, a reception-frequency resonance circuit is formed by (a) the inductance L formed by the peripheral conductor 30 and the meandering conductor 10, and (b) the capacitance C formed by the peripheral conductor 30 and the counter electrode 20.

As is shown in FIG. 1, the peripheral conductor 30 has two long lateral parts, i.e., an upper long lateral part 30*a* and a lower long lateral part 30*b*. When two such long lateral parts are installed, the inductance formed between the peripheral conductor 30 and the meandering conductor 10 and the capacitance formed between the peripheral conductor 30 and the counter electrode 20 are larger than they are in cases where only one such long lateral part is installed, i.e., in cases where the peripheral conductor 30 has an "L" shape. Specifically, these values are approximately doubled as a result of this arrangement. Furthermore, the Q is increased by an amount corresponding to the parallel inductance, so that the resonance characteristics are improved.

Furthermore, in FIG. 1, the line width of the meandering conductor is approximately 1.5 mm. If this width is made any wider, the inductance L drops. Moreover, the distance between the meandering conductor 10 and the peripheral conductor 30 is set so that it is approximately the same as the line width of the meandering conductor 10. Furthermore, in this embodiment, the counter electrode 20 is more or less rectangular. However, this electrode 20 could also be formed in some other shape such as round, triangular or square, etc. Moreover, the line width of the peripheral conductor 30 is set so that it is approximately twice the line width of the meandering conductor 10; however, this value may be determined so that the transmission loss is minimized.

The numerical values are merely examples; other values may also be used. These values may be altered as desired in accordance with the reception frequency and required degree of coupling, etc. For example, if the inductance L is insufficient when an antenna coupling circuit C1 such as that shown in FIG. 1 is actually constructed, the peripheral conductor 30 may be lengthened. Furthermore, in cases where signals of a lower frequency are to be received, the inductance must be increased.

Figure 2:
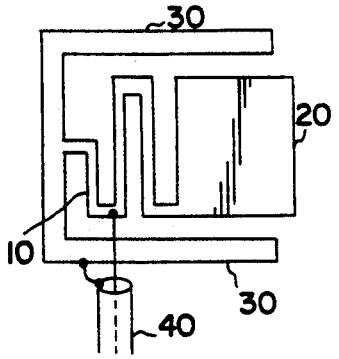
FIG. 2 shows an example in which the embodiment is connected to a coaxial cable.

In FIG. 2, the outer conductor of the coaxial cable 40 is connected to the peripheral conductor 30, and the core of the coaxial cable 40 is connected to the meandering conductor 10. Furthermore, in cases where the feeder impedance value is high, the core of the coaxial cable 40 may also be connected to the counter electrode 20.

Figure 3:
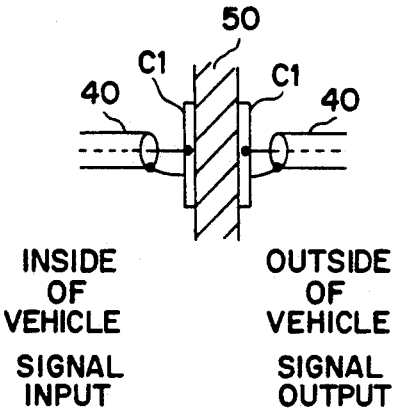
FIG. 3 shows an example in which two antenna coupling circuits are installed facing each other via a glass in the embodiment.

In FIG. 3, one antenna coupling circuit C1 is attached to the outside of the vehicle window glass 50. A coaxial cable 40 is connected as shown in FIG. 2, and an antenna is to be connected to the other end of said coaxial cable 40. Another antenna coupling circuit C1 is installed on the inside of the vehicle window glass 50; this inside antenna coupling circuit C1 is connected to a receiver by means of a coaxial cable 40.

In conventional plane circuits (distributed constant circuits), an area of approximately 150×25 mm is required in the case of the automobile telephone frequency band, around 900 MHz. In this embodiment, however, an area of approximately 45×25 mm is sufficient. The reason that the area can be reduced in this manner in this embodiment is that the length of the circuit required in order to obtain the inductance L needed for a resonance circuit is reduced by means of the meandering conductor 10.

In FIG. 3, the two antenna coupling circuits C1 are set facing in the same direction. In other words, when the circuitry is viewed from inside or outside the vehicle, it appears as though only one antenna coupling circuit C1 is installed on the glass 50. Assuming that the angle of discrepancy between the two antenna coupling circuits C1 is zero degrees in this case, the same degree of coupling can also be obtained when this angle of discrepancy is approximately 180 degrees. In cases where two antenna coupling circuits C1 are installed on the glass 50, there are no restrictions on the angle of discrepancy; however, when said angle of discrepancy is 90 degrees, the degree of coupling is reduced.

Furthermore, in cases where two antenna coupling circuits C1 are installed on the glass 50, one on either side of said glass 50, it is desirable to affix the copper-foil surface of the printed circuit board making up each antenna coupling circuit C1 on the side of the glass 50 using a two-sided adhesive tape, etc. in order to increase the electrostatic capacitance. However, in view of the required waterproof properties, etc., it is not always necessary to fix the copper-foil surfaces on the side of the glass 50. Specifically, the antenna coupling circuits C1 are molded, but two-sided adhesive tape used is ordinarily hydroscopic. Accordingly, rain water may penetrate into the two-sided adhesive tape, causing a deterioration in the insulation, etc. In order to prevent this, it is desirable to fix the copper-foil surfaces of the circuit boards away from glass 50.

Furthermore, it is also possible to construct the coupling circuits C1 using a two-sided printed circuit board. In this case, either one or two of the circuit elements, i.e., the meandering conductor 10, counter electrode 20 and peripheral conductor 30, are installed on one side of the two-sided printed circuit board, i.e., the side of said board on which the two-sided adhesive tape is not installed. Of course, the meandering conductor 10, counter electrode 20 and peripheral conductor 30 are electrically connected as shown in FIG. 1.

In this case, it is desirable to install the counter electrodes 20 on the surfaces of the two-sided printed circuit boards which are positioned on the side of the glass 50, i.e. on the surfaces of said circuit boards on which the two-sided adhesive tape is installed in order to increase the electrostatic capacitance between the counter electrode 20 of the coupling circuit C1 installed on the outside of the glass 50 and the counter electrode 20 of the coupling circuit C1 installed on the inside of the glass 50. Furthermore, from the standpoint of waterproof properties, it is desirable that the meandering conductors 10 and peripheral conductors 30 be installed on the surfaces of the two-sided printed circuit boards which face away from the glass 50, i.e., on the surfaces of said circuit boards on which the two-sided adhesive tape is not installed.

Furthermore, the peripheral conductors 30 also affect the electrostatic capacitance; accordingly, in cases where it is desired to increase the electrostatic capacitance even further, it is desirable to install the counter electrodes 20 and peripheral conductors 30 on the surfaces of the two-sided printed circuit boards which face the glass 50, and to install the meandering conductors 10 on the surfaces of said two-sided printed circuited boards which face away from the glass 50.

Figure 4:
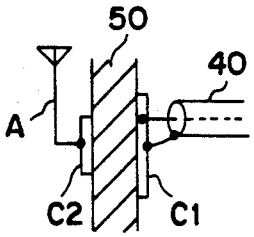
FIG. 4 (1) and 4 (2) illustrate a modification of the embodiment.
Figure 4:
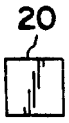

As is shown in FIG. 4 (1), the circuitry on the inside of the glass 50 is the same as in the example illustrated in FIG. 3. However, an antenna coupling circuit C2 consisting only of a counter electrode 20 is installed on the outside of the glass 50, and an antenna A is connected to this antenna coupling circuit C2. In the case illustrated in FIG. 4, the antenna (A) is of the type shown in FIG. 8 and described hereinafter.

Figure 5:
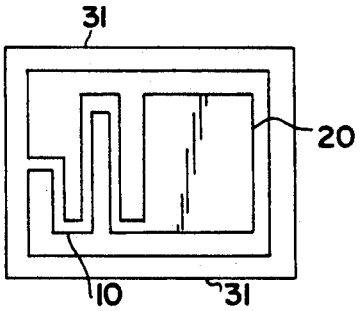
FIG. 5 is a plan view of an antenna coupling circuit which illustrates another embodiment of the present invention.

In the embodiment illustrated in FIG. 5, a peripheral conductor 31 formed by making the peripheral conductor 30 in the embodiment illustrated in FIG. 1 into a ring-form conductor is installed. In the embodiment, the meandering conductor 10 and counter electrode 20 are the same as in the embodiment illustrated in FIG. 1.

Figure 6:
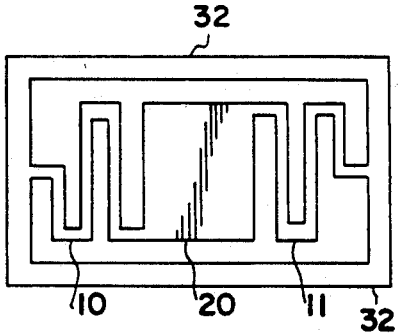
FIG. 6 (1) is a plan view which illustrates yet another embodiment of the present invention.
Figure 6:
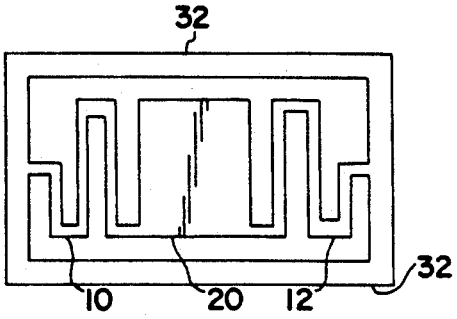

The embodiment illustrated in FIG. 6 (1) is similar to the embodiment illustrated in FIG. 5 in that a meandering conductor 10 and a counter electrode 20 are installed inside a peripheral conductor 32. In the embodiment illustrated in FIG. 6 (1), however, a second meandering conductor 11 is connected between the peripheral conductor 11 is connected between the peripheral conductor 32 and the counter electrode 20. This second meandering conductor 11 is installed on the opposite side of the counter electrode 20 from the meandering conductor 10.

The embodiment illustrated in FIG. 6 (1) consists of a circuit which is formed by connecting (a) a circuit formed by making the antenna coupling circuit C1 illustrated in FIG. 1 point-symmetrical with respect to the counter electrode 20, and (b) the antenna circuit C1 illustrated in FIG. 1. On the other hand, the modified embodiment illustrated in FIG. 6 (2) consists of a circuit which is formed by connecting (a) a circuit formed by making the embodiment illustrated in FIG. 1 line-symmetrical with respect to the central part of the counter electrode 20, and (b) the antenna circuit C1 illustrated in FIG. 1.

Figure 9:
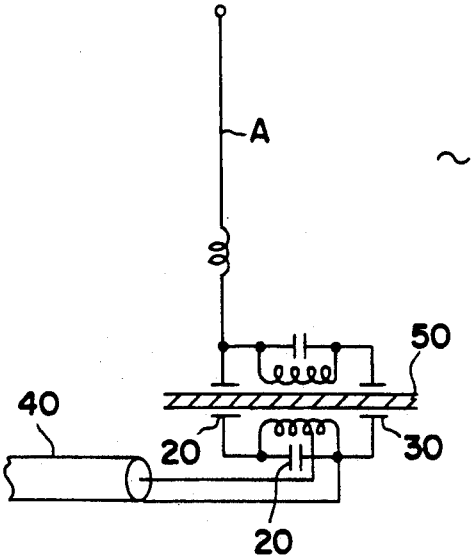
FIG. 9 is an equivalent circuit of the coupler of FIG. 6.

An equivalent circuit of the embodiments of FIG. 6 (1) and (2) is shown in FIG. 9 and clearly shows the interrelation and construction of the inductive and capacitive elements.

Figure 7:
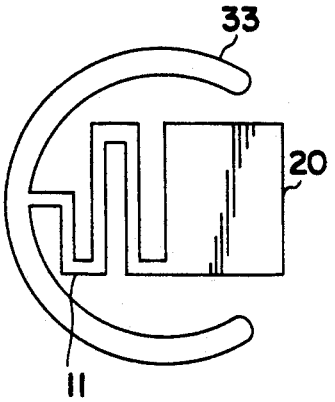
FIGS. 7 (1) and 7 (2) illustrate still other embodiments of the present invention.
Figure 7:
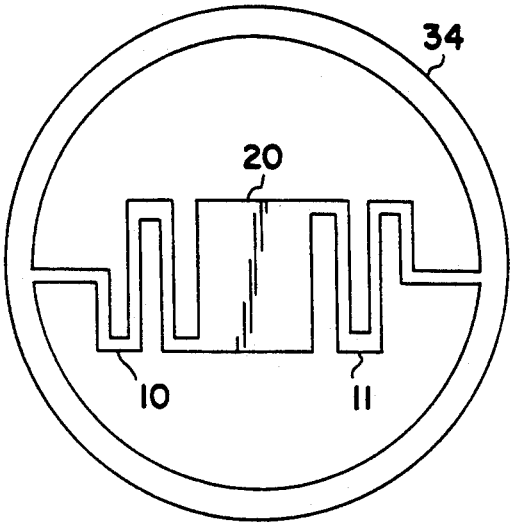

In the example illustrated in FIG. 7 (1), the peripheral conductor 30 of the antenna coupling circuit C1 illustrated in FIG. 1 is replaced by a "C"-shaped peripheral conductor 33. In the example illustrated in FIG. 7 (2), the peripheral conductor 32 of the antenna coupling circuit C4 illustrated in FIG. 6 (1) is replaced by a circular peripheral conductor 34.

Figure 8:
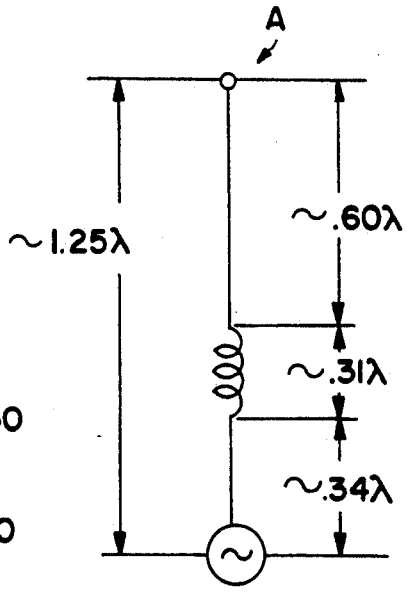
FIG. 8 is a simplified illustration of an antenna utilized with the coupling circuit of the present invention.

Referring to FIG. 8, shown therein is a simplified view of the antenna A. The antenna A comprises a lower mast section of approximately 0.34 wavelength in the cellular telephone band (825 MHz to 895 MHz), an upper mast section of approximately 0.60 wavelength in the cellular telephone band and an intermediate coil of approximately 0.31 electrical wavelength at the cellular telephone band for a total length of approximately 1.25 wavelengths in the cellular telephone band.

Furthermore, in the embodiments illustrated in FIGS. 5 and 6, it would also be possible to form the peripheral conductors 31 and 32 using some other ring-form shape such as pentagonal or hexagonal, etc. Also, in the embodiments described above, the antenna coupling circuits were installed facing each other via a window glass 50. However, it would also be possible to install said antenna coupling circuits facing each other via some other insulator such as the plastic body panel of the vehicle, etc.

We claim:

1. An antenna coupling circuit for a motor vehicle using capacitive coupling, said coupling circuit comprising: a first plane circuit for mounting on one side of an insulator comprising a meandering conductor, a first counter electrode which is connected to one end of said meandering conductor, said first counter electrode having a surface area larger than a surface area of said meandering conductor, and a peripheral conductor at least partially surrounding said meandering conductor and first counter electrode which is connected to the other end of the meandering conductor and an inductance is formed by said meandering conductor extending between said peripheral conductor and the first counter electrode and a capacitance is formed between said peripheral conductor and the counter electrode; a second plane circuit for mounting on another side of said insulator comprising: a second counter electrode which is substantially the same size and shape as the first counter electrode; an antenna connected to the second counter electrode; and a signal feed line coupled to said meandering conductor of said first plane circuit and wherein said second plane circuit further comprises a second meandering conductor which is connected to said second counter electrode, said second counter electrode having a surface area larger than a surface area of said second meandering conductor, and a second peripheral conductor at least partially surrounding said meandering conductor and second counter electrode which is connected to the other end of the second meandering conductor, and an inductance is formed by said second meandering conductor extending between said second peripheral conductor and the second counter electrode, and a capacitance is formed between said second peripheral conductor and the second counter electrode.

2. An antenna coupling circuit using capacitive coupling, as defined in claim 1, which is characterized by the fact that said peripheral conductor is formed in a shape selected from the group consisting of the shape of a "]", the shape of the letter "L", the shape of the letter "C", or the shape of a ring.

3. An antenna coupling circuit using capacitive coupling, as defined in claim 1, the meandering conductor, the counter electrode and the peripheral conductor of at least one of the plane circuits are formed on a printed circuit board.

4. An antenna coupling circuit using capacitive coupling, as defined in claim 1, wherein the meandering conductor, the counter electrode and the peripheral conductor of at least one of the plane circuits are formed on a two-sided printed circuit board.

5. An antenna coupling circuit according to claim 1 wherein said insulator is a window glass of said motor vehicle.

6. An antenna coupling circuit according to claim 5 wherein said antenna has an electrical length of substantially 1.25 wavelengths at a cellular telephone band.

* * * * *